US006510631B1

(12) United States Patent
Baggarly

(10) Patent No.: US 6,510,631 B1
(45) Date of Patent: Jan. 28, 2003

(54) PICTURE FRAME ASSEMBLY WITH COIN HOLDING BORDER

(76) Inventor: Patricia Baggarly, 9702 Waterfront Dr., Manassas, VA (US) 20111

( * ) Notice: Subject to any disclaimer, the term of this patent is extended or adjusted under 35 U.S.C. 154(b) by 0 days.

(21) Appl. No.: 09/632,622

(22) Filed: Aug. 4, 2000

(51) Int. Cl.[7] ..... A47G 1/06

(52) U.S. Cl. ..... 40/323; 206/0.84; 40/798; 40/768

(58) Field of Search ..... 40/323, 798, 800, 40/768, 735; 206/0.81, 0.82, 0.83, 0.84

(56) References Cited

U.S. PATENT DOCUMENTS 88,910 A * 4/1869 Sadler ..... 40/735
3,554,625 A * 1/1971 Sly, Sr. ..... 40/323
3,957,157 A * 5/1976 Therrien ..... 206/0.83
4,878,579 A * 11/1989 Hager ..... 206/0.83
5,884,755 A * 3/1999 Vaccarella ..... 206/0.84
6,119,386 A * 8/2000 Henry et al. ..... 40/735

* cited by examiner

*Primary Examiner*—Cassandra H. Davis
(74) *Attorney, Agent, or Firm*—Alfred F. Hoyte, Jr.

(57) ABSTRACT

A picture frame assembly has a border with recesses for holding coins. The border consists of an internally mounted framing component having a plurality of circular recesses formed therein. The internal edges of the framing component are designed to slightly overlap the edges of the picture or photo to be framed, while the external edges are designed to fit under the external border of the frame. A backing member immediately adjacent the framing component cooperates with the apertures formed in the framing component to create recessed into which coins may be placed. The date of the coins coincides with the date of the photo or picture and thus provide an indication of the date of the photo or picture. The backing member is held in position relative to the framing component by a clamp, which also serves to bind the frontal border and glass plate in position thereby completing the frame assembly.

3 Claims, 4 Drawing Sheets

PICTURE FRAME ASSEMBLY WITH COIN HOLDING BORDER

BACKGROUND OF THE INVENTION

The present invention relates generally to picture frames. More particularly, it relates to a picture frame assembly having a border which can be used to contain coins.

STATEMENT OF THE PRIOR ART

Numerous types of picture frames having various types of decorative borders have been made over the years. These borders, usually arbitrary and unrelated to the picture to be framed, are generally in the form of indicia printed or otherwise affixed to the border of the frame.

U.S. Pat. No. 5,916,650 issued to Rosenbaum et al. discloses a display cover for temporary use which may be used to frame pictures which are posted upon a surface such as a refrigerator. The cover has a border with indicia and other graphics. By contrast, the present invention contemplates a picture frame for permanent use which has recess for receiving date bearing indicia.

U.S. Pat. No. 5,072,532 issued to Kelly discloses a decorative picture frame having an ornamental designed disposed on an expanded side border or top border issued to is another patent directed to a. By contrast, the present invention contemplates a decorative picture frame having a framing component which has means for supporting a plurality of coins having date bearing indicia.

None of the above inventions and patents, taken either singly or in combination, is seen to describe the instant invention as claimed.

SUMMARY OF THE INVENTION

The present invention overcomes the disadvantages of the prior art by providing a picture frame having a border with recesses for holding coins. The border consists of an internally mounted framing component having a plurality of circular recesses formed therein. The internal edges of the framing component are designed to slightly overlap the edges of the picture or photo to be framed, while the external edges are designed to fit under the external border of the frame. A backing member immediately adjacent the framing component cooperates with the apertures formed in the framing component to create recessed into which coins may be placed. The date of the coins coincides with the date of the photo or picture and thus provide an indication of the date of the photo or picture. The backing member is held in position relative to the framing component by a clamp, which also serves to bind the frontal border and glass plate in position thereby completing the frame assembly.

Accordingly, it is a principal object of the invention to provide a picture frame assembly having means for supporting coins.

It is another object of the invention to provide a picture frame assembly having a border containing date bearing indicia.

It is another object of the invention to provide a picture frame assembly having a plurality of recesses sized to receive coins bearing date indicia.

Finally, it is a general object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Various other objects, features, and attendant advantages of the present invention will become more fully appreciated as the same becomes better understood when considered in conjunction with the accompanying drawings, in which like reference characters designate the same or similar parts throughout the several views, and wherein.

DETAILED DESCRIPTION

Figure 1:
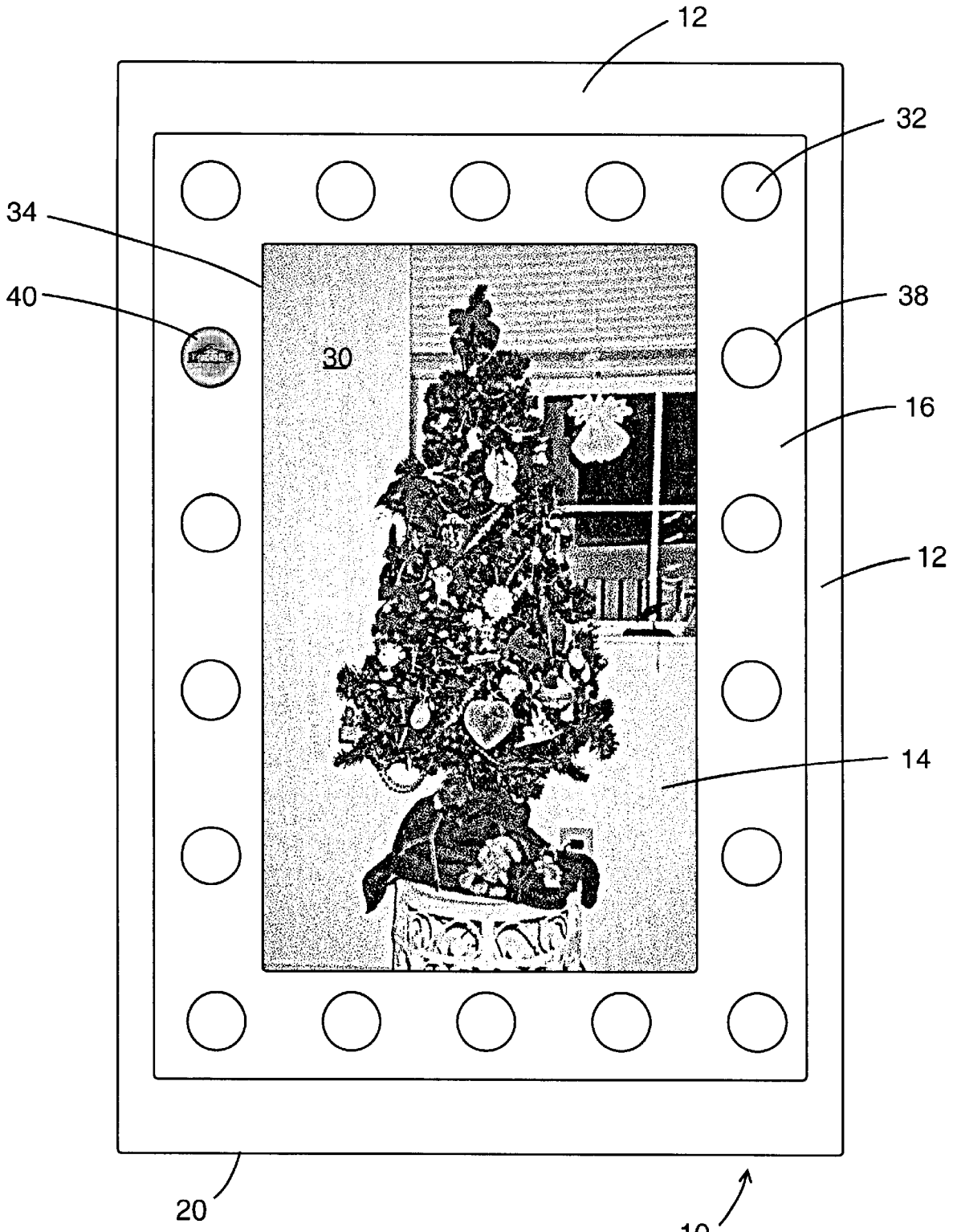
FIG. 1 shows a plan view of the frame assembly of the present invention.

Referring now to FIGS. 1–4, the frame assembly of the present invention, generally indicated by the numeral 10, is shown. The assembly 10, includes a border or primary framing component 12, a glass plate 14, an interior framing component 16 and a backing panel 18. Border 12 has a front face or molding 20, which may be contoured or have decorative features as is well known in the art. The rear face 22 of the border 12 has a recess 24 formed therein, the recess 24 having a sufficient depth to allow for the thickness of the glass plate 14 and interior framing component 16. A plurality of clamping members 26, arranged about the periphery of the recess 24 and pivotally attached thereto, serve to hold the backing panel 18 in position.

Glass plate 14 provides a protective barrier for the photo or picture 30 contained therein and may, as a safety feature, have beveled or rounded edges to prevent injury to persons handling the frame assembly 10. Of course, another transparent material may be used in place of the glass plate 14.

The interior framing component 16 has a plurality of apertures 32 formed therein. The apertures 32 are preferably regularly spaced and are sized in accordance with the sizes of coins issued by the U.S. Treasury, i.e., either the penny, nickel, dime, quarter, etc. Apertures 32 may be sized in accordance with the currency sizes of other countries. Apertures 32 of one or several sizes may be employed, and the arrangement may vary as a matter of design choice or for artistic purposes. Inner edges 34 of the framing component 16 define the viewing area of the picture 30 contained within the frame assembly 10. When the framing component 16 is mounted within the frame assembly 10 apertures 32 cooperate with the backing panel 18 to form recesses 38 within which the coins 40 may be placed.

Figure 3:
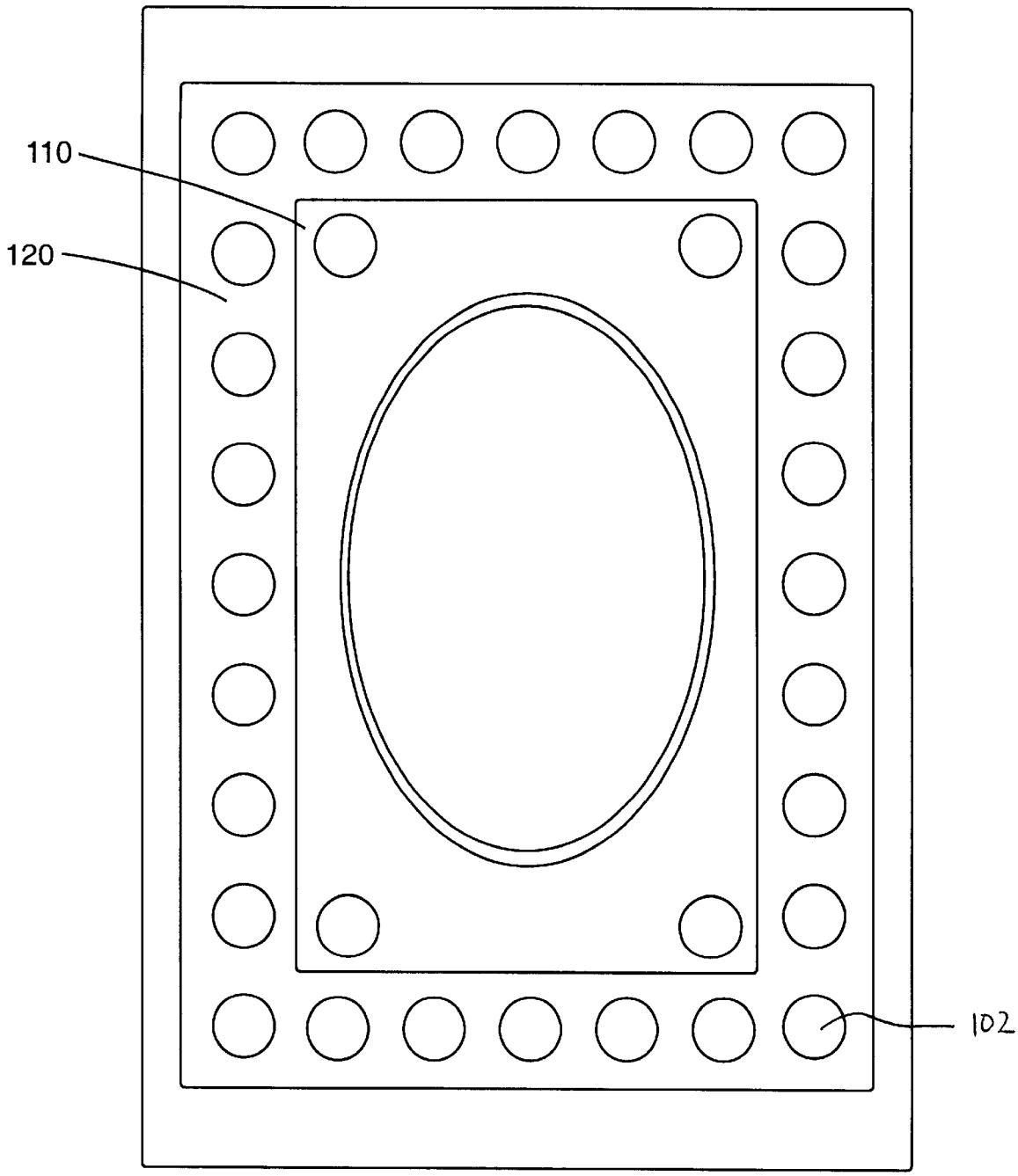
FIG. 3 shows an alternative arrangement of the framing component of the present invention.

It is a primary feature of the invention to provide a means by which photos, pictures or other rendered images to be framed may be dated. To that end, the coins 40 are chosen to correspond to the date the photo or picture was taken, printed, commissioned, etc. Thus, subsequent viewers of the pictures or photos 30 have an immediate reference for the date. The arrangement of the coins 40 may be entirely arbitrary as may be the shape of the frame assembly 10. For instance, the framing component 16 may be oval while the border 12 is rectangular as is shown in FIG. 3. It should also be noted that in lieu of framing component 16, recesses may be formed within the mat area 44 of the border 12.

Figure 4:
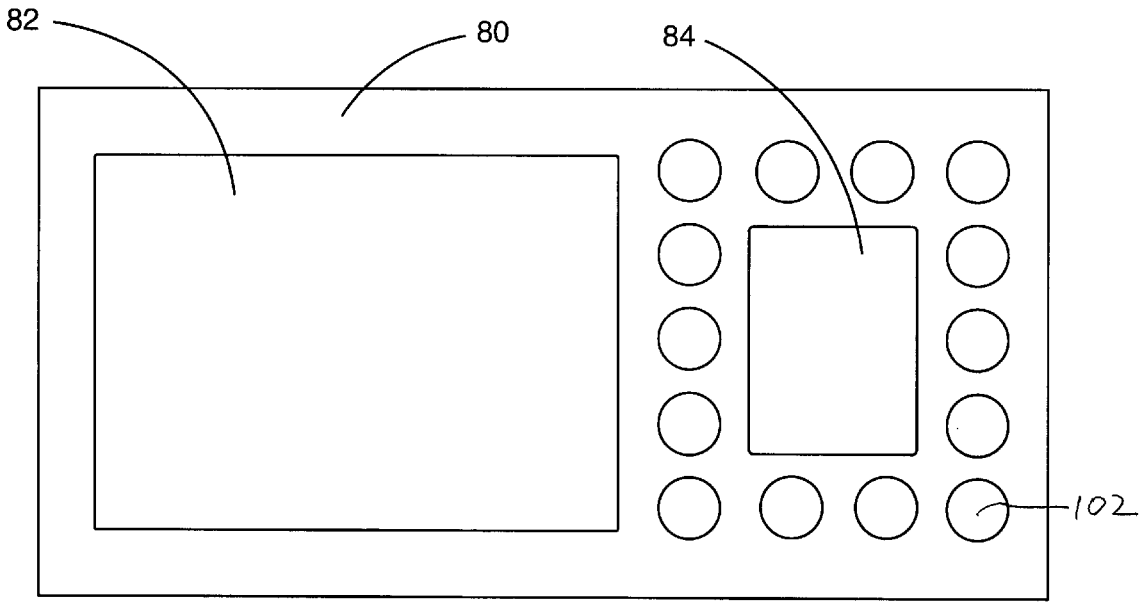
FIG. 4 shows another alternative arrangement of the framing component of the present invention.

FIGS. 3–4 show alternative arrangements for the frame assembly 10. FIG. 4 shows a frame assembly 80 having space for containing both a team photo 82 and an individual photo 84. In a multiple photo arrangement where the frame assembly has space for a group of photos, coins having different dates could be placed by the different photos. Coins 102 adjacent the photo may show the date of the individual photo, and may be changed as new photos are inserted. FIG. 3 shows an oval framing component 110 within a rectangular frame 120 as has been previously discussed.

Figure 2:
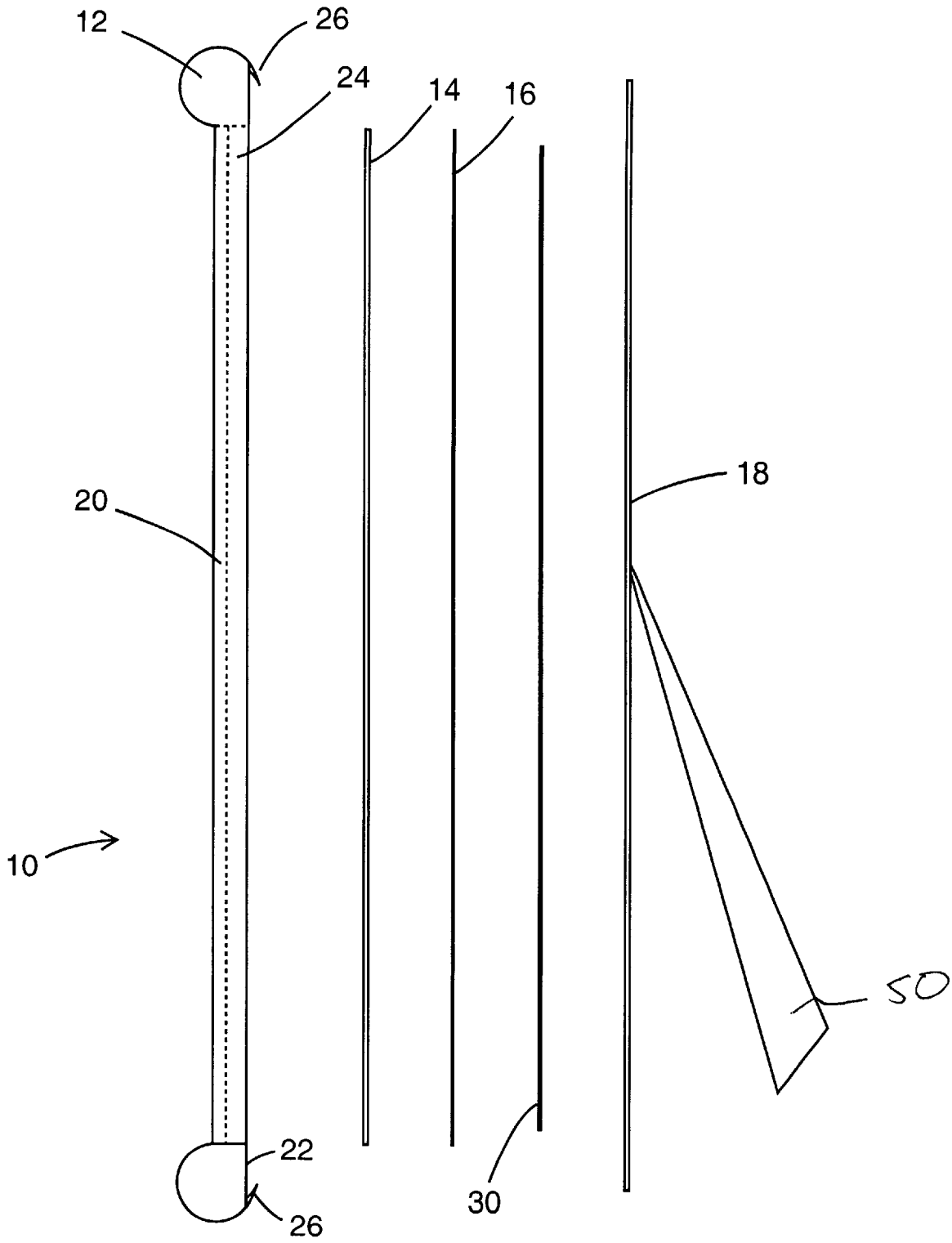
FIG. 2 shows a shows an exploded side view, partly in section, of the frame assembly of the present invention.

In operation, the frame assembly 10 is assembled by placing the photo 30 upon the backing member 18 and arranging the framing component 16 as desired upon the photo 30 thereby defining the viewing area. The coins 40, 102 which are chosen to correspond to the date of the photo 30 are then placed within the recesses 38. The assembly 10 is then set up for display and viewing by inserting glass 14, framing component 16, photo 30, and backing panel 18 as shown in FIG. 2, using clamps 26 to secure all of the components in position. Support member 50 may then be positioned to support the entire assembly 10 in an upright position. Alternatively, in lieu of support member 50, means for wall mounting (not shown) may be used to support the assembly 10 upon a wall other vertical surface. Also, with advent of the new state quarters being minted, the state (e.g., Pennsylvania) in which the picture was taken may be indicated by placing the appropriate state quarter into apertures 32. The quarters may be inserted with the front or back side showing, with at least some of the quarters showing the date.

From the foregoing description, one skilled in the art can easily ascertain the essential characteristics of this invention and, without departing from the spirit and scope thereof, can make various changes and modifications of the invention to adapt it to various usages and conditions.

It is to be understood that the present invention is not limited to the sole embodiment described above, but encompasses any and all embodiments within the scope of the following claims.

What is claimed is:

1. A method of displaying a photograph or picture comprising:

mounting said photograph or picture, said photograph or picture having date information associated therewith, in a first display area of a frame assembly having at least two separate display areas;

mounting at least one coin having data indicia in a second display area so as to display the indicia on said coin;

wherein said date information is a year date the photograph or picture was rendered, and said date indicia is a year date, said coin selected so that said year date is equivalent to the year date the photograph or picture was rendered.

2. The method of claim 1 wherein said second display area includes a plurality of recesses within which coins may be inserted, said method further including the step of placing additional coins having year dates equivalent to the date indicia the photograph or picture was rendered in all of said recesses.

3. A picture frame assembly comprising:

a primary framing member having an exterior border and an interior recess;

a transparent panel positioned within said interior recess immediately adjacent said primary framing member, said transparent panel sized to fit within said recess and extending beneath interior edges of said border, an interior framing component positioned in underlying relation to said transparent panel and having a centrally disposed viewing aperture, said interior framing component having at least one secondary aperture formed therein;

a backing panel mounted in adjacent underlying relation to said interior framing component and cooperating with said at least one secondary aperture in said framing component to create a corresponding recessed region, said recessed region bordering said viewing aperture;

a photograph positioned between said backing panel and said framing component, said photograph having date information associated therewith;

at least one coin positioned in said recessed region, said coin having date indicia thereon;

said date information is a year date the photograph was taken, and said date indicia is a year date that the coin was minted, said year date the photograph was taken being coincident to the year date the coin was minted.

* * * * *